US011359364B1

(12) United States Patent
Eller et al.

(10) Patent No.: US 11,359,364 B1
(45) Date of Patent: Jun. 14, 2022

(54) SYSTEMS AND METHODS FOR JOINING SPACE FRAME STRUCTURES

(71) Applicant: LOCKHEED MARTIN CORPORATION, Bethesda, MD (US)

(72) Inventors: Michael R. Eller, New Orleans, LA (US); Darren Andrew Kearney, Slidell, LA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 0 days.

(21) Appl. No.: 17/114,361

(22) Filed: Dec. 7, 2020

(51) Int. Cl.
*E04B 1/19* (2006.01)

(52) U.S. Cl.
CPC .... *E04B 1/1903* (2013.01); *E04B 2001/1927* (2013.01); *E04B 2001/1969* (2013.01)

(58) Field of Classification Search
CPC ..... E04B 1/1903; E04B 2001/1927; E04B 2001/1969; E04B 1/2406; E04B 2001/2421; E04B 2001/2439; E04B 2001/2469; E04B 1/1906; E04B 2001/1921; E04B 1/34305
USPC ..... 403/322.2
See application file for complete search history.

(56) References Cited

U.S. PATENT DOCUMENTS 1,257,455 A * 2/1918 Braun ..... E04B 1/1903 403/218
3,921,360 A 11/1975 Baldwin
4,323,319 A * 4/1982 Adams ..... A47B 47/0008 403/171
4,664,550 A * 5/1987 Jachmann ..... E04B 1/1903 403/171
4,932,807 A 6/1990 Rhodes
5,127,759 A * 7/1992 Orbom ..... E04B 1/1903 403/171
5,144,780 A * 9/1992 Gieling ..... E04B 1/5831 135/114
6,082,070 A * 7/2000 Jen ..... E04B 1/24 403/170
6,378,265 B1 4/2002 Konstandt
6,439,797 B1 * 8/2002 Campbell ..... F16B 21/165 403/316
7,476,824 B2 1/2009 Ananthanarayanan et al.
D614,481 S 4/2010 Lewis
10,774,518 B1 9/2020 Eller
2004/0182299 A1 9/2004 Kent et al.
2006/0053729 A1 3/2006 Wallner
2010/0071141 A1 3/2010 Reiner
2010/0083605 A1 4/2010 Wallner
2015/0064375 A1 3/2015 Kunstadt
2015/0101645 A1 4/2015 Neville et al.
2015/0167713 A1 5/2015 Schaerer et al.
2019/0027835 A1 1/2019 Hoyt
(Continued)

*Primary Examiner* — Patrick J Maestri
(74) *Attorney, Agent, or Firm* — Bakerhostetler

(57) ABSTRACT

A strut-and-node truss design that is applicable to all space frame structure designs can be made with using robotic (semi-autonomous and/or fully autonomous) or telerobotic assembly/joining. Nodes can include a 2-dimensional weld path in an effort to reduce the complexity of having to weld in 3-dimensions. Furthermore, each strut to node connection can be concentrated in a small area where each weld can be performed robotically from a fixed position that only requires the robotic weld head to swivel in a small operating window to reach each joint.

19 Claims, 19 Drawing Sheets

(56) References Cited

U.S. PATENT DOCUMENTS

| | | | |
|---|---|---|---|
| 2019/0135456 | A1 | 5/2019 | Wingo et al. |
| 2019/0284792 | A1 | 9/2019 | López Blanco |

* cited by examiner

SYSTEMS AND METHODS FOR JOINING SPACE FRAME STRUCTURES

STATEMENT REGARDING FEDERALLY SPONSORED RESEARCH OR DEVELOPMENT

Not Applicable.

TECHNICAL FIELD

The present description relates in general to space frame structures, and more particularly to, for example, without limitation, systems and methods for joining space frame structures.

BACKGROUND OF THE DISCLOSURE

Space frame structures are one of the efficient and commonly used structures used on Earth and in space. Space frame structures are typically truss-like and are used for constructing: buildings, bridges, aircraft, automobiles, spacecraft, and tensegrity structures. Design of modern space frame structures has not changed much since the advent of mechanical fasteners and fusion welding processes back in the industrial revolution era. Hence many large space frame structures involve intricate assembly steps that require significant human interaction and skill. The majority of space frame structures require highly skilled fusion welders to make difficult pipe welds that are the most complicated and defect-ridden joints because of the difficult fit up, accessibility, and positioning required to make full circumferential welds. Thus far, space frame designs and methods suitable for robotic (semi-autonomous and/or fully autonomous) or telerobotic assembly/joining has not yet emerged as a viable solution to replace "handmade" truss structures.

The description provided in the background section should not be assumed to be prior art merely because it is mentioned in or associated with the background section. The background section may include information that describes one or more aspects of the subject technology.

Figure 1:
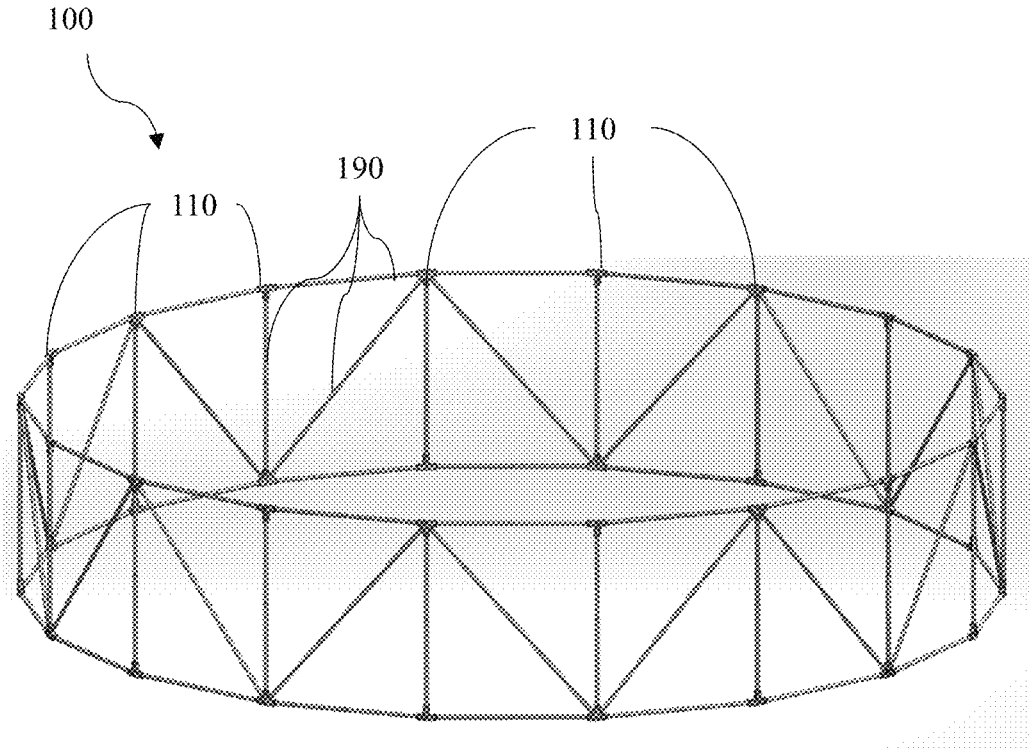
FIG. 1 illustrates a perspective view of an example of a rim truss structure, according to embodiments of the present disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The present disclosure provides a new design and method for building space frame structures with minimal human interaction. Using robotic assembly and joining methods to build large space frame structures on Earth will have a significant technology roadmap before it is deemed safe for humans to safely work and live on (and under) structures built by robots. Therefore, the most realistic near-term use for robotically manufactured space frame structures is where space frame construction is the most expensive and most difficult for humans to build by hand: outer space.

It can be desirable to build structures in space more efficiently to enable capability growth and capability preservation of various space-based functions such as human exploration, scientific discovery, and satellite operations. A significant limitation to growing and preserving these functions are the high cost and long lead time of transporting payloads into space. The payloads must be designed to withstand up to 10 G launch loads, but will ultimately operate in an environment with 0 G or minimal G-force loads. Therefore, a tremendous amount of design and configuration testing could be eliminated if the payload could be launched into orbit as raw materials and manufactured/assembled in space. Furthermore, the launching of raw materials instead of deployable/unfurlable payloads will create a transformational change in the volumetric packing efficiency within a given launch vehicle's payload fairing. Manufacturing and assembly of raw materials in space is complicated.

Modern space frame structures are expensive to manufacture and are almost always reliant on complex assembly procedures requiring human labor and skills. This is especially true for space transportation solutions because large payloads are required to deploy and unfurl since a suitable design and joining method for robotic assembly has not been developed yet.

It can be beneficial to introduce a specific joint that can be joined by robots instead of humans. Common truss structures in use today take advantage of the strut-and-node design to maximize structural stiffness with minimal weight.

One aspect of the present disclosure provides a strut-and-node truss design that is applicable to all space frame structure designs with using innovative robotic (semi-autonomous and/or fully autonomous) or telerobotic assembly/joining. Embodiments of the present disclosure can create transformational change to the space transportation and exploration as well as adoption into terrestrial construction industry.

Entire truss structures such as those disclosed herein are capable of being mechanically assembled (e.g., by robots) prior to immobilization of all the connections with brazing and/or welding. This avoids the stack-up tolerances and distortion from progressively heating various parts of the structure in series. The mechanisms described herein include ball spring plungers (e.g., detents) that hold precise positioning of the struts that can be repositioned with a proper amount of force (e.g., from the robotic arm). The ball spring plungers provide adequate amount of pull out strength to keep the strut positioned during assembly and provide additional pull out strength after the strut is bonded via brazing or welding. The struts can push into the node member past their final position while the node member on the opposite end is connected to other struts. Subsequently, the strut can be pulled back to its final position at node members on both ends.

The more conventional approach of welding each individual strut and node for hundreds or thousands of repeating segments gives rise to incredible difficulty with thermal distortion, misalignment tolerances, and tolerance stack-up. Furthermore, such constructions requires a complex 3-D fillet joint that is equivalent to performing a pipe weld. Corresponding techniques impose difficulty achieving the proper weld penetration on this type of joint given the geometry of the fit-up and the limited accessibility to view and inspect the weld.

3-D printing techniques currently cannot produce multi-materials such as a composite tube with metallic ends that have a neutral CTE similar to what is being proposed for some of the in-space structures in this invention. 3-D printing of metals in particular also suffers from severe thermal distortion because of the amount of heat that is required and the time the heat must be applied to make a part (or entire structure) from raw materials. Just the thermal distortion witnessed from making a small number of welds on a truss structure is enough to make misalignment tolerances one of the biggest challenges to control. Furthermore, the amount of power required in space for making such a large structure is much more prohibitive than the brazing or deposition approach outlined in this invention.

The strut and node designs described herein enable use of brazing or deposition as joining technologies that utilize less power and energy than welding. The reduced heat input enables our the disclosed approach to achieve the fine tolerances required for building precise truss structures in space for reflector antennas, telescopes, etc. The unobstructed line of sight access to the strut and node joint enables reduced robotic arm articulation and makes use of a smaller operating window which are both hugely advantageous for in-space robotic operations. When line of sight is not designed into the node, the induction coil/heating element can still be inserted with minimal robotic manipulation in order to accomplish the brazing operation.

Referring now to FIG. 1, applications of a node-and-strut design can include an assembly of truss structures that serve as structural support for devices, such as antennas. As shown in FIG. 1, one example of an assembly configuration is a cylindrical truss rim that is the structural stiffening element for a mesh reflector element that is tensioned to the truss rim. The truss structure 100 can be assembled in space from raw materials: struts 190 and node members 110 and 110. The struts 190 can be, for example, graphite epoxy and bonded aluminum ends and the node members can include, for example, aluminum, titanium, and the like.

A robot or other assembly mechanism can assemble the entire structure with mechanical connections first to ensure that everything can fit into the proper locations before fixing them in place. The engagement between the struts 190 and the node members 110 can facilitate adjustments between different temporary arrangements so the components can be assembled in stages. Once the truss structure 100 has been fully assembled with mechanical joints, the robotic welding head can bond, weld, fuse, or otherwise fixedly couple each joint. This allows the truss structure 100 to retain fine assembly tolerances with minimal distortion.

Figure 2:
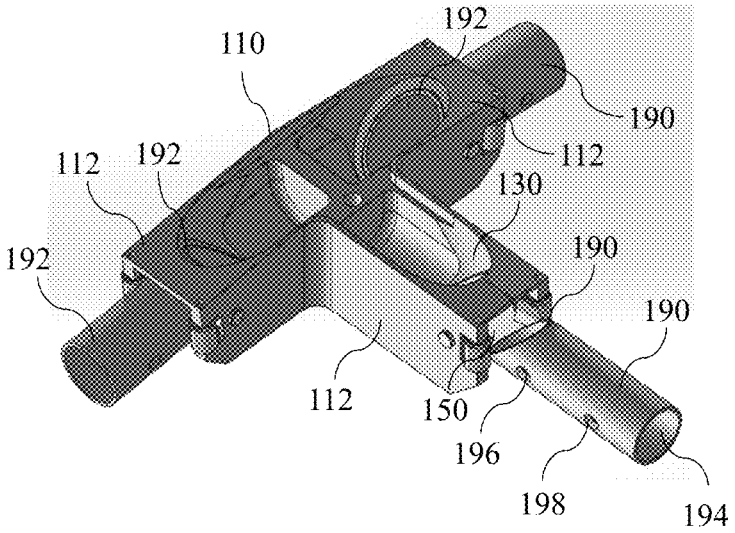
FIG. 2 illustrates a perspective view of an example of a node member with struts, according to embodiments of the present disclosure.

Referring now to FIG. 2, a truss structure can include one or more node members 110 and struts 190 coupled together through an assembly process that results in a secure arrangement. The node member 110 can include a main body 112 that defines an outer periphery, one or more channels 150, and one or more interior chambers 130. The channels 150 can be open to, in fluid communication with, or otherwise connected to one or more interior chambers 130 formed by the main body 112 of the node member 110. The interior chambers 130 can provide access to a terminal end 192 of a strut 190 when the strut 190 is within the channel 150. A single node member 110 can couple to multiple struts 190, and multiple node member 110 can be provided to form an overall truss structure. For example, multiple channels 150 can be provided, with each extending inwardly into the main body 112 from an outer periphery thereof. While three struts 190 are shown in FIG. 2, any number of struts 190 can be joined to a single node member 110. Additionally or alternatively, a single strut 190 can couple to multiple node members 110 (e.g., at opposite ends of the strut 190), and multiple struts 190 can be provided to form an overall truss structure A strut 190 can include terminal ends 192, wherein a given terminal end 192 is configured to fit within a corresponding channel 150 of the node member 110. The struts 190 can include multiple engagement elements for interacting with corresponding elements of the node member 110 when the strut 190 is inserted into the channel 150. For example, the struts 190 can include, at or near one or more ends thereof, one or more outer strut engagement elements 196 and one or more inner strut engagement elements 198. The outer strut engagement elements 196 can be closer to a terminal end 192 than are the inner strut engagement elements 198. It will be understood that the terms "inner" and "outer" do not necessarily refer to radially inner and radially outer, but can instead refer to relative longitudinal positions of the engagement elements. The strut engagement elements 196 and 198 can alternatively engage with corresponding engagement elements of the node member 110 at different amounts of insertion of the strut 190 into the channel 150, as described further herein.

Figure 3:
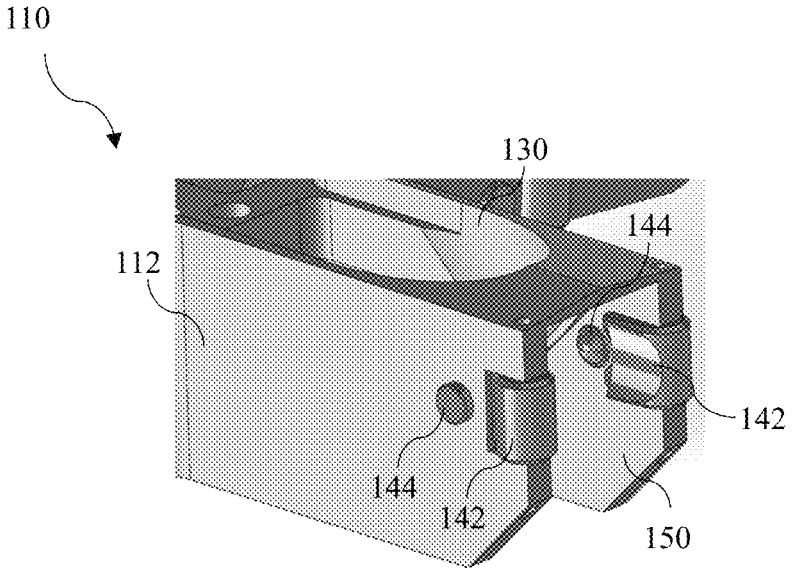
FIG. 3 illustrates an enlarged perspective view of the node of FIG. 2, according to embodiments of the present disclosure.

Referring now to FIG. 3, the node member 110 can form the channel 150 extending into the main body 112, as well as an internal chamber 130. As shown in FIG. 3, the node member 110 can include various elements for interacting with a strut when inserted into the channel 150. For example, the node member 110 can include one or more node member engagement element 144 that engages one or more of the corresponding strut engagement elements. The node member engagement element 144 can include, for example, detents (e.g., ball detents) that are biased to protrude into the channel 150. By further example, the node member engagement elements 144 can be any structure that releasably engages the strut upon insertion to a certain extent into the channel. Such engagement and release can optionally be automated upon insertion of the strut. Additionally or alternatively, engagement and release can be manually controlled.

As further shown in FIG. 4, the node member 110 can further include guide members 142, which can be positioned at the periphery of the main body 112. The guide members 142 can guide the strut as it is inserted into the channel 150. For example, the guide members 142 can have a shape (e.g., concave) on surfaces thereof that are complementary to the shape of the strut 190. The guide members 142 can be biased toward the channel 150 to urge the strut 190 toward an interior of the channel 150 as it is inserted, as well as to maintain the strut 190 in a proper orientation while within the channel 150.

Figure 4A:
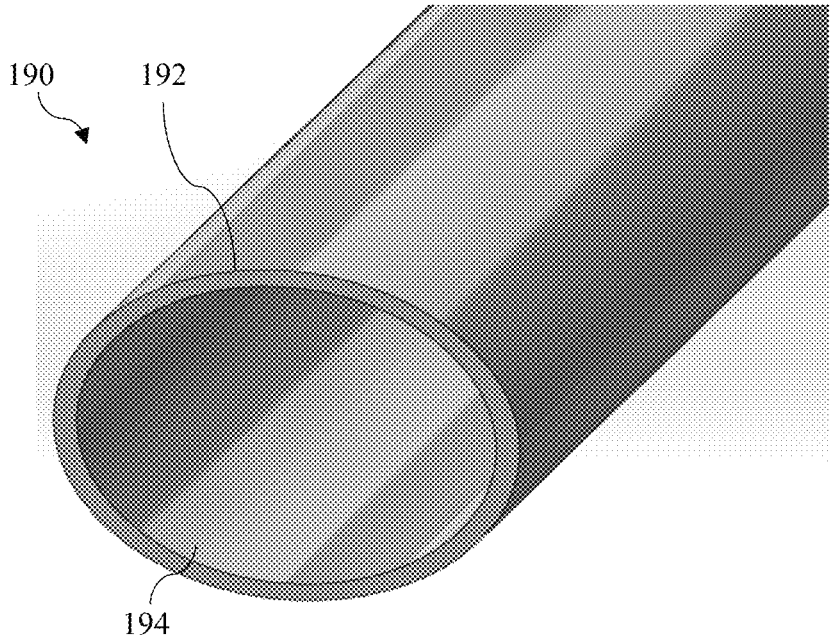
FIG. 4A illustrates a perspective view of an example of a strut with an elliptical end when cut at a 45-degree angle, according to embodiments of the present disclosure.
Figure 4B:
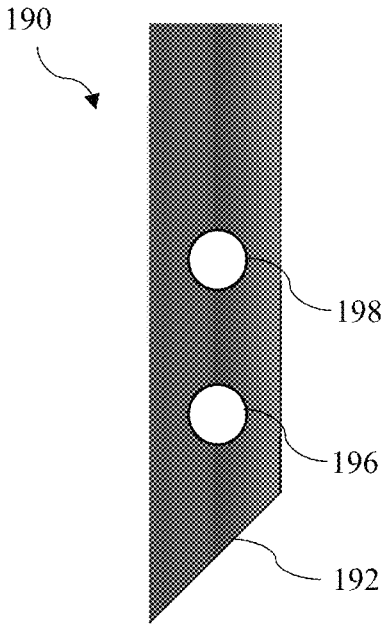
FIG. 4B illustrates a side view of an example of the strut of FIG. 4A, according to embodiments of the present disclosure.
Figure 4C:
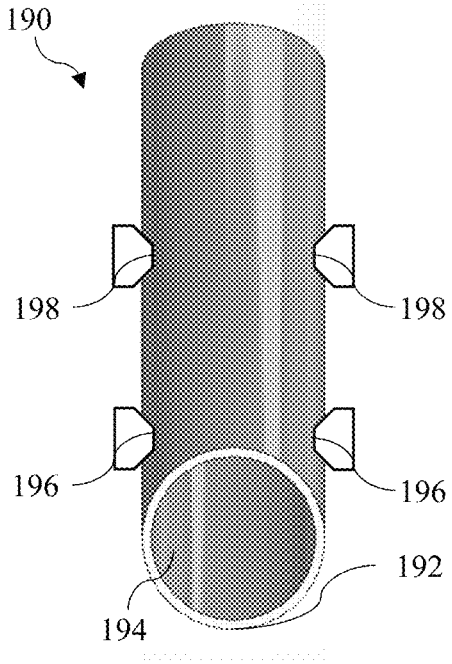
FIG. 4C illustrates another side view of an example of the strut of FIG. 4A, according to embodiments of the present disclosure.

Referring now to FIGS. 4A-4C, the struts 190 can extend along a longitudinal axis and have a terminal end 192. Along the length, the struts 190 can be cylindrical with a circular cross-section. At the terminal ends 192, the struts 190 can provide a surface at an angle such that the end face is elliptical. The angle can be with respect to the longitudinal axis of the strut 190. The angle can be between 30 and 60 degrees, for example 45 degrees. The elliptical face is inserted into the channel of the node member. Additionally or alternatively, the struts 190 can be hollow, solid, or combinations thereof. The struts described herein can be a single material or multi-material. The multi-material struts/tubes have the advantage of having neutral Coefficient of Thermal Expansion (CTE) that is highly desirable for precision space structures because of the large variation in temperature in space.

As shown in FIGS. 4B and 4C, the outer strut engagement elements 196 and the inner strut engagement elements 198 can form depressions, divots, openings, and/or holes into and/or through the strut, optionally to an inner lumen 194 thereof. The outer strut engagement elements 196 and the inner strut engagement elements 198 can form conical or other concave shapes for receiving engagement elements of the node member, as described further herein.

Referring now to FIGS. 5-8, a method of assembling a truss structure is shown with operations in a particular sequence. The illustrated operations need not be performed in the order shown and/or one or more operations need not be performed and/or can be replaced by other operations.

Figure 5:
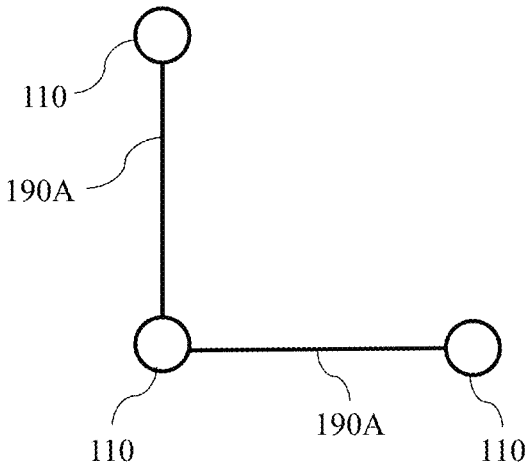
FIG. 5 illustrates a schematic view of a truss in a stage of assembly, according to embodiments of the present disclosure.

As shown in FIG. 5, at least one strut 190A and at least one node member 110 can be provided. Before additional struts and node members are provided to complete an enclosed area (e.g., with a closed loop), it can be desirable to provided other struts for support. Where such struts extend between node members that are otherwise connected, it can be desirable to allow the struts to adjust their degree of insertion to accommodate alignment with a node member on an opposite end of the strut.

Figure 6:
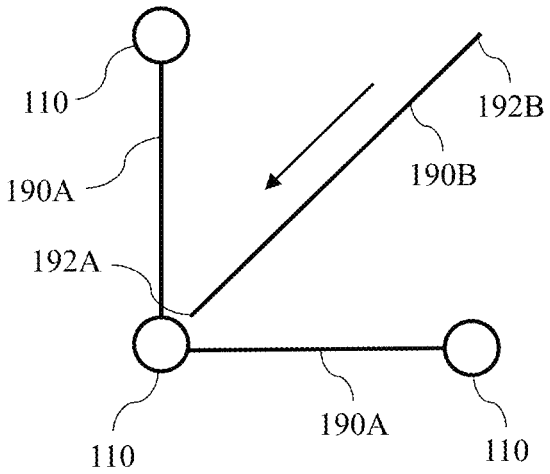
FIG. 6 illustrates a schematic view of the truss of FIG. 5 in another stage of assembly, according to embodiments of the present disclosure.
Figure 7:
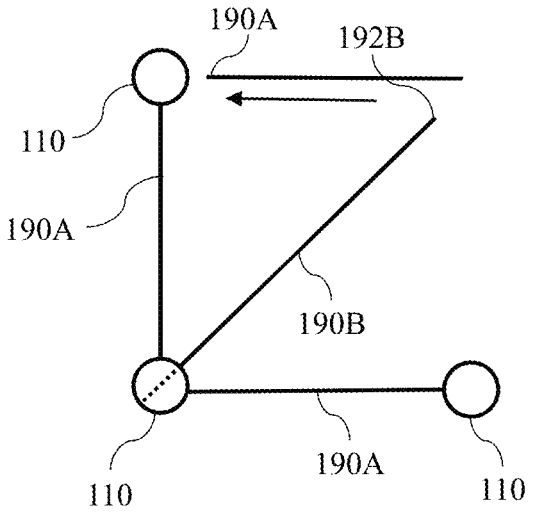
FIG. 7 illustrates a schematic view of the truss of FIG. 6 in another stage of assembly, according to embodiments of the present disclosure.
Figure 8:
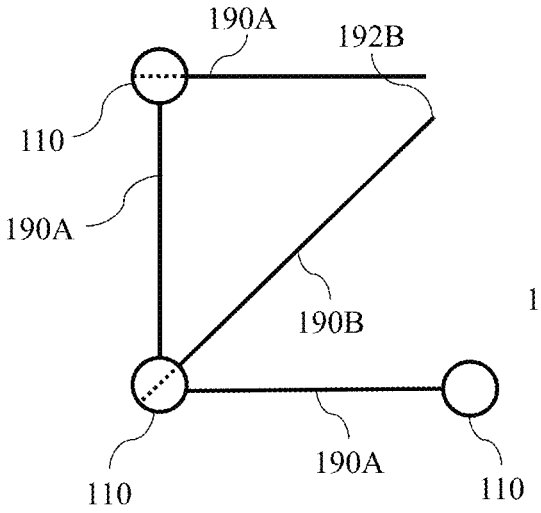
FIG. 8 illustrates a schematic view of the truss of FIG. 7 in another stage of assembly, according to embodiments of the present disclosure.

As shown in FIGS. 6 and 7, a first end 192A of a strut 190B (e.g., a diagonal strut) is inserted into a first node member 110. At such a stage, an inner engagement element of the strut 190B can engage with the node member 110 (e.g., after an outer engagement element has moved past the corresponding node member engagement element). As shown in FIG. 7, the second end 192B of the strut 190B can be left unconnected temporarily. As shown in FIGS. 7 and 8, a first end of a strut 190A (e.g., a side strut) is inserted into another node member 110. At such a stage, an inner engagement element of the strut 190A can engage with the additional node member 110 (e.g., after an outer engagement element has moved past the corresponding node member engagement element). As shown in FIG. 8, the second end of the strut 190A can be left unconnected temporarily.

Figure 9:
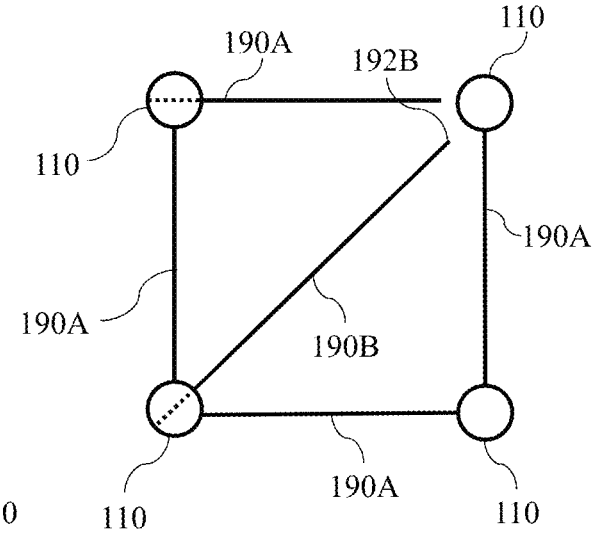
FIG. 9 illustrates a schematic view of the truss of FIG. 8 in another stage of assembly, according to embodiments of the present disclosure.

As shown in FIG. 9, a second node member 110 can be aligned with the second end 192B of the strut 190B and a second end of the strut 190A. At such a time, the struts 190A and 190B are inserted to a greater extent into the corresponding node members 110, such that the exposed ends do not interfere with placement of the second node member.

Figure 10:
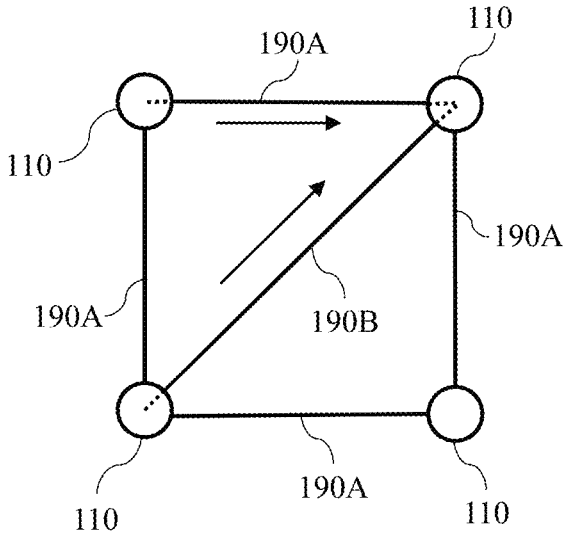
FIG. 10 illustrates a schematic view of the truss of FIG. 9 in another stage of assembly, according to embodiments of the present disclosure.

As shown in FIG. 10, the struts 190A and 190B can each be retracted. In such an arrangement, outer engagement elements of the struts 190A and 190B can engage with the opposing node members. Such engagement can occur simultaneously and after the engagement of FIGS. 7-9 is released. The struts 190A and 190B can be fixed in such an arrangement, as can the other struts 190A.

Referring now to FIGS. 11-17, a method of assembling a truss structure is shown with operations in a particular sequence. The illustrated operations need not be performed in the order shown and/or one or more operations need not be performed and/or can be replaced by other operations. While only one end is shown, it will be understood that the mechanisms illustrated and described can apply to each of two ends of a strut, with corresponding node members aligned thereat.

Figure 11:
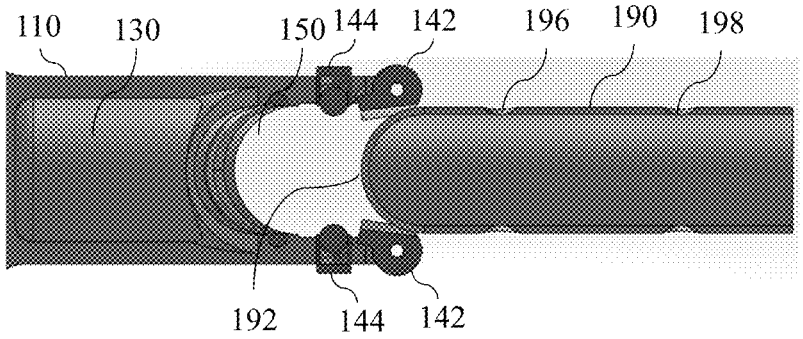
FIG. 11 illustrates a sectional view of a node member and strut in a stage of assembly, according to embodiments of the present disclosure.

As shown in FIG. 11, the strut 190 can be inserted into the channel, optionally guided by the guide members 142. For example, when the terminal end 192 is inserted into the channel 150, the guide members 142 are biased inward to contact the strut 190.

Figure 12:
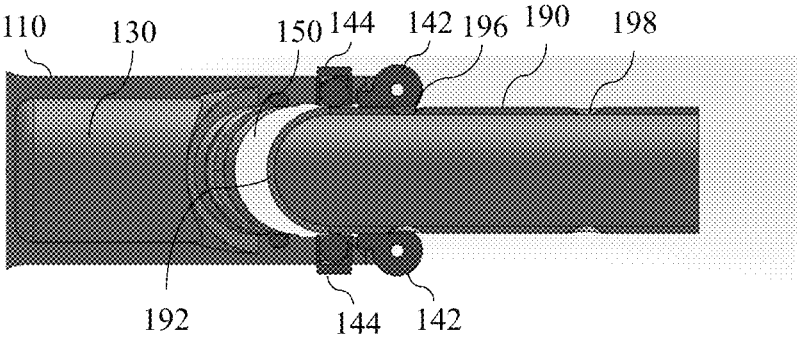
FIG. 12 illustrates a sectional view of the node member and strut of FIG. 11 in another stage of assembly, according to embodiments of the present disclosure.

As shown in FIG. 12, the guide members 142 can be retracted upon contact with the strut 190. As the strut 190 moves further into the channel 150, the guide members 142 can direct the strut 190 along a desired path. Additionally, the node member engagement elements 144 (e.g., ball detents) can be retracted upon contact with the strut 190.

Figure 13:
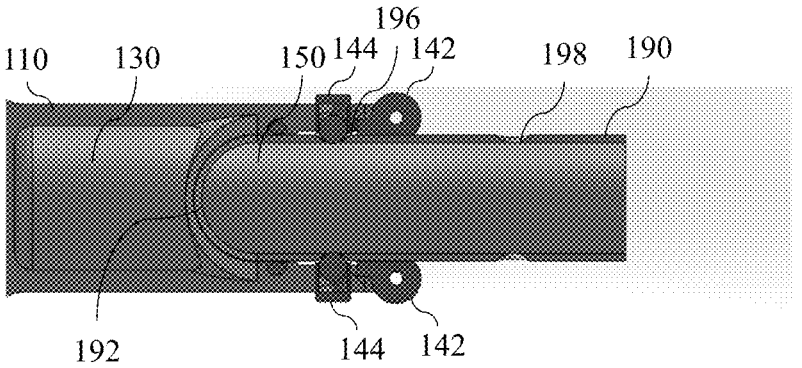
FIG. 13 illustrates a sectional view of the node member and strut of FIG. 12 in another stage of assembly, according to embodiments of the present disclosure.

As shown in FIG. 13, upon further insertion (e.g., to a first engaged position), the node member engagement elements 144 can engage the outer strut engagement elements 196. For example, a ball (e.g., spherical) shape of the node member engagement elements 144 can be seated within the conical or other depression of the outer strut engagement elements 196. Such engagement can maintain a relative position and/or orientation of the strut 190 and the node member 110. Such engagement can be overcome when a threshold force along the longitudinal axis of the strut 190 is exceeded.

Figure 14:
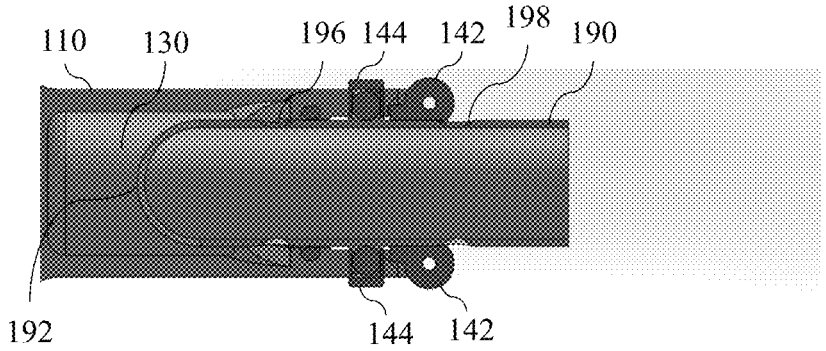
FIG. 14 illustrates a sectional view of the node member and strut of FIG. 13 in another stage of assembly, according to embodiments of the present disclosure.

As shown in FIG. 14, upon further insertion, the node member engagement elements 144 can disengage from the outer strut engagement elements 196, as they move past the node member engagement elements 144.

Figure 15:
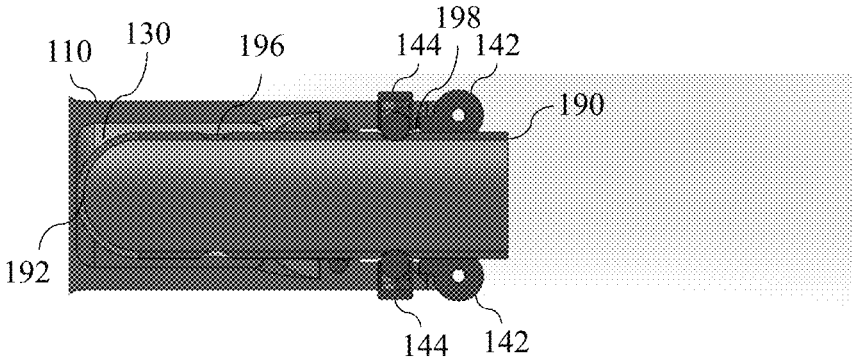
FIG. 15 illustrates a sectional view of the node member and strut of FIG. 14 in another stage of assembly, according to embodiments of the present disclosure.

As shown in FIG. 15, upon further insertion (e.g., to a second engaged position), the node member engagement elements 144 can engage the inner strut engagement elements 198. For example, the ball (e.g., spherical) shape of the node member engagement elements 144 can be seated within the conical or other depression of the inner strut engagement elements 198. Such engagement can maintain a relative position and/or orientation of the strut 190 and the node member 110. Such engagement can be overcome when a threshold force along the longitudinal axis of the strut 190 is exceeded. Such an arrangement can correspond to the arrangement of the strut and node member of FIG. 8 (i.e., at the first end of the strut). As such, it represents a deeper insertion of the strut into the node member, thereby allowing an opposite end not to occupy a space required to align an additional node member.

Figure 16:
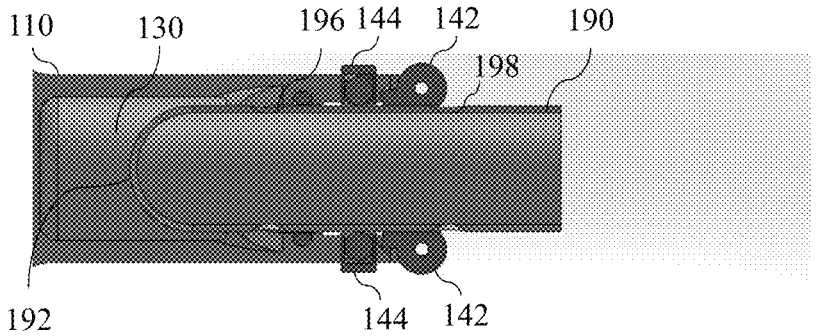
FIG. 16 illustrates a sectional view of the node member and strut of FIG. 15 in another stage of assembly, according to embodiments of the present disclosure.

As shown in FIG. 16, upon initial retraction, the node member engagement elements 144 can disengage from the inner strut engagement elements 198, as they move away from the node member engagement elements 144.

Figure 17:
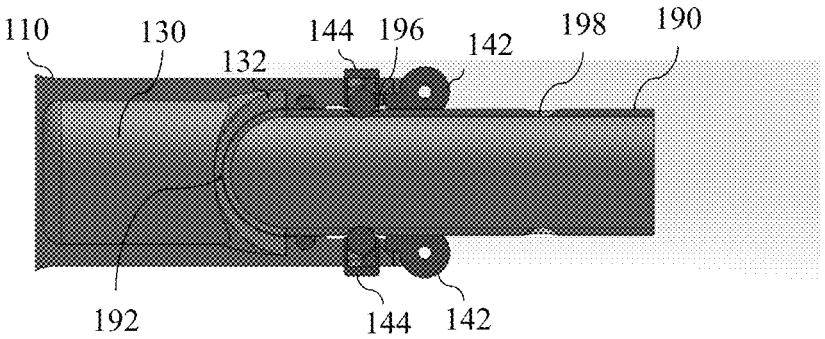
FIG. 17 illustrates a sectional view of the node member and strut of FIG. 16 in another stage of assembly, according to embodiments of the present disclosure.

As shown in FIG. 17, upon further retraction (e.g., again to the first engaged position), the node member engagement elements 144 can engage the outer strut engagement elements 196. Such an arrangement can correspond to the arrangement of the strut and node members of FIG. 10 (i.e., at each end of the strut). As such, it represents a more shallow insertion of the strut into the node members, thereby facilitating engagement with each.

It will be understood that further adjustments can be made by moving the struts to different extents of insertion in one or more node members. As such, adjustments can be made at least until the struts are fixed in place relative to the node members.

Figure 18:
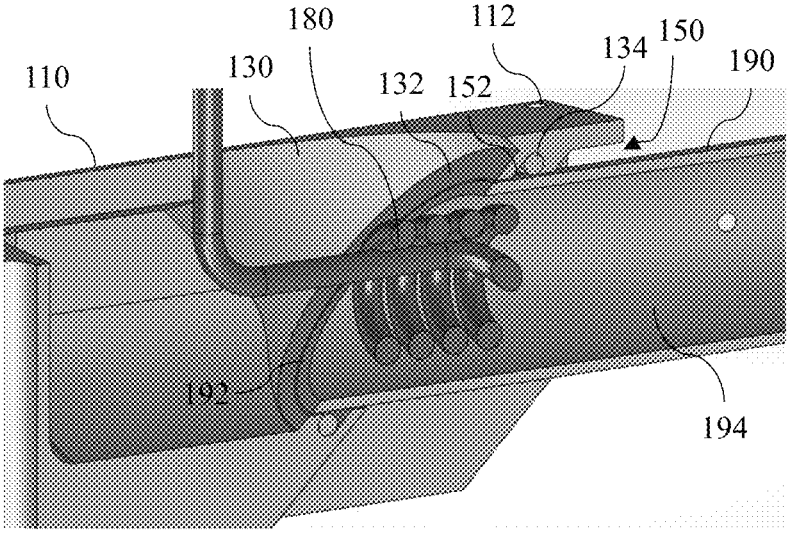
FIG. 18 illustrates a perspective sectional view of a node member and strut with a welding element, according to embodiments of the present disclosure.
Figure 19:
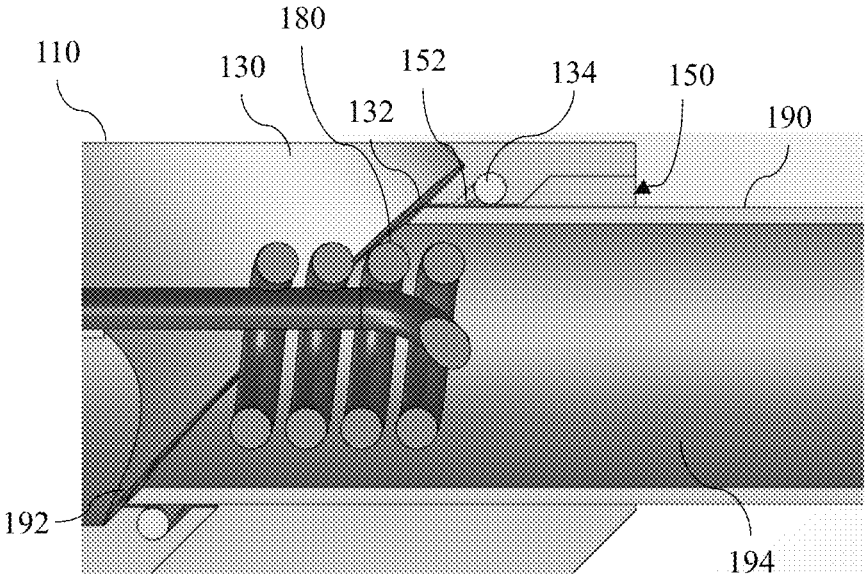
FIG. 19 illustrates a sectional view of the node member and strut of FIG. 18 with the welding element, according to embodiments of the present disclosure.

Referring now to FIGS. 18-21, a bonding element can be provided to fix the strut in place relative to a node member. As shown in FIGS. 18 and 19, the main body 112 of the node member 110 can form an annular recess 152 radially adjacent to the channel 150. A bond element 134 can be disposed in the annular recess 152. The bond element 134 can form a ring or other shape. The bond element 134 can avoid protruding into the channel 150, so that the strut 190 can move freely therein. The bond element 134 can be configured to bond to the strut 190 and/or the node member 110 when heat is applied. The bond element 134 can include a metal having a melting point that is lower than a melting point of the main body 112 and a melting point of the strut 190. Such a metal can include an aluminum alloy, an aluminum-silicone alloy, a titanium alloy, a titanium-silicone alloy, and the like.

Bonding the strut 190 to the node member 110 can be performed with a heating element 180. For example, the heating element can be an inductive element, such as a coil configured to receiving an electrical current. Other types of heating elements are contemplated, such as resistive heating elements, electron beams, laser welders, and the like. By applying heat to (e.g., inducing electrical current in) the bond element 134, the bond element 134 can melt and fuse, weld, and/or braze to the strut 190 and the node member 110.

Figure 20:
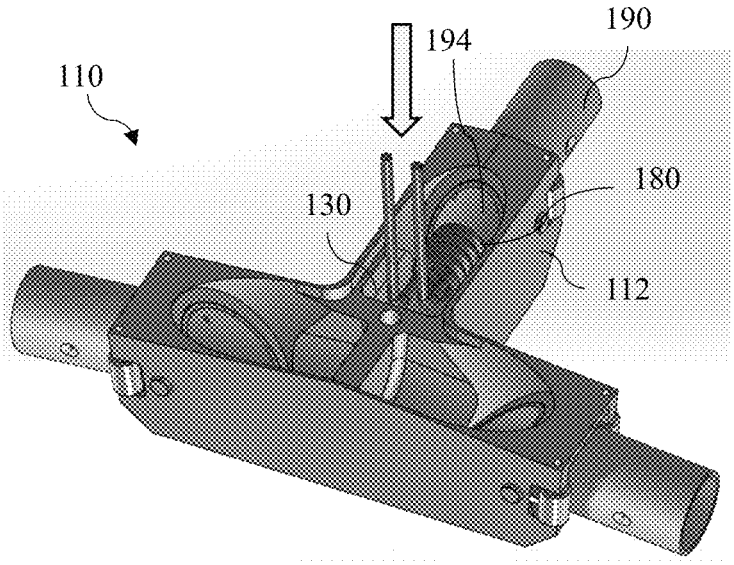
FIG. 20 illustrates a perspective view of a node member and strut with a welding element, according to embodiments of the present disclosure.
Figure 21:
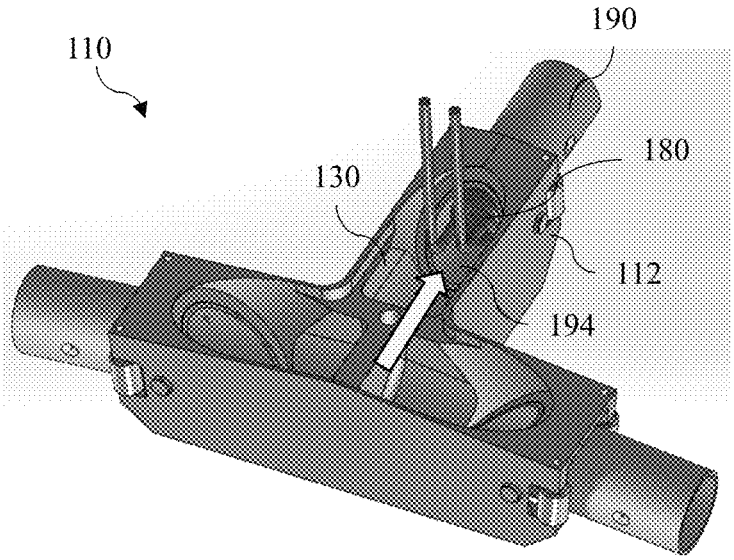
FIG. 21 illustrates a perspective view of the node member and strut of FIG. 20 with the welding element, according to embodiments of the present disclosure.

As shown in FIGS. 20 and 21, access to the bond element can be provided through an internal chamber 130 of the node member 110. While the strut 190 is within the node member 110, the lumen 194 of the strut 190 can be open to the internal chamber 130. The heating element 180 can be inserted into the internal chamber 130 and then advanced into the lumen 194 of the strut 190 to be aligned with the bond element. Additionally or alternatively, heat can be applied from outside of the strut 190 to melt the bond element and facilitate fusion, welding, and/or brazing.

Additionally or alternatively, the terminal end of the strut 190 can be bonded and/or fused to a surface of the node member, such as the surface 132 facing the internal chamber 130. Such bonding can be done from outside of a lumen 194 (if any) of the strut 190.

The truss nodes are fundamentally configured such that the joining end effector has unobstructed line of sight access to the strut 190 and an interface plane of the node member 110. This enables 2-dimensional welding, brazing, or deposition onto this interface area with minimal degrees of robotic manipulation. To access all the strut end joints in this manner, the ends of the struts 190 can be cut at an angle (as high as 60 degrees or as low as 30 degrees) and inserted into an annular hole or slot to position the strut for welding to the node member 110. When configured specifically for brazing, the node members 110 have pre-installed braze rings within grooves in the node slot for bonding to inserted struts. Line of sight access is not required for some brazing operations that simply need to insert a heating element 180, such as an induction coil, resistance heating element, or a laser or electron beam into the open end of the strut 190. These struts can be cut, for example, at a 90° angle and still enable minimal robotic articulation to bond the node members 110 to the struts 190. The heat source only needs to articulate inside the lumen 194 of the strut 190 along the longitudinal axis of the strut 190 in order to apply the heat to the pre-installed braze rings within the channels.

Figure 22:
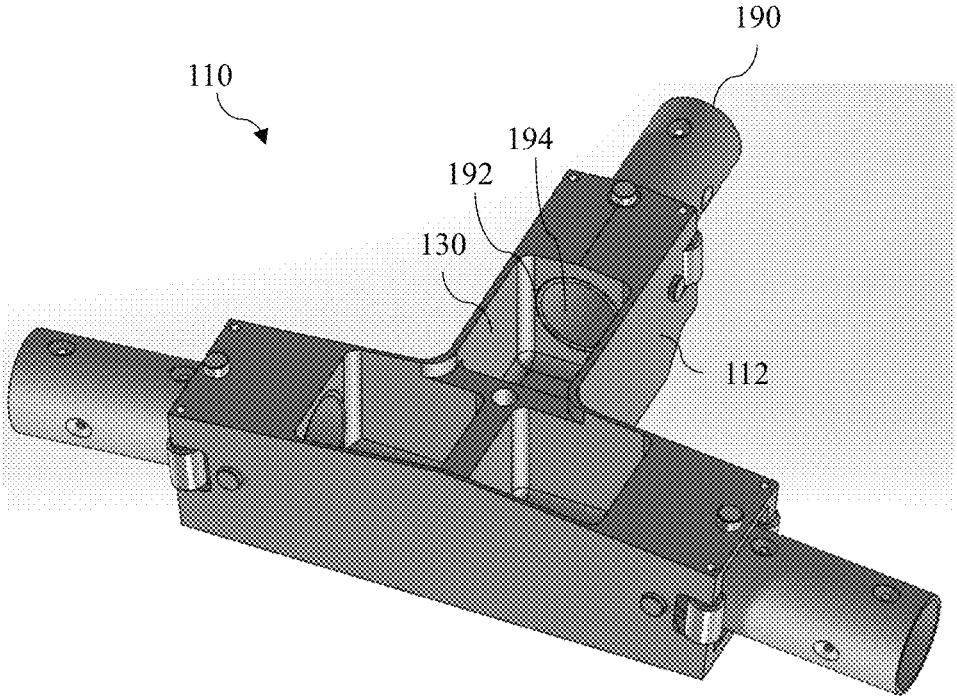
FIG. 22 illustrates a perspective view of a node member and strut, according to embodiments of the present disclosure.

Referring now to FIG. 22, it will be understood that the ends 192 of the struts 190 can form one or more of a variety of shapes, and the node member 110 can accommodate such shapes. For example, the ends 192 of the struts 190 can be squared (e.g., circular in cross-section) to be essentially flat.

Figure 23:
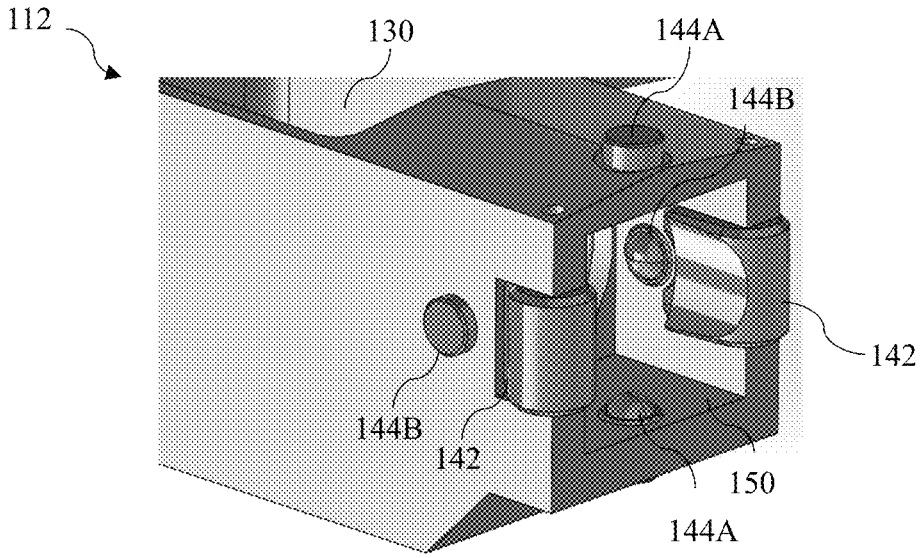
FIG. 23 illustrates an enlarged perspective view of a node, according to embodiments of the present disclosure.
Figure 24:
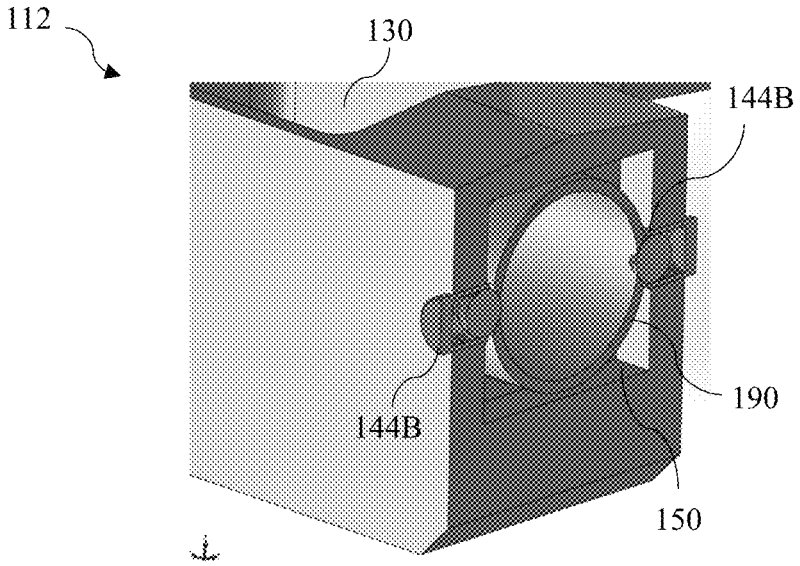
FIG. 24 illustrates a perspective sectional view of the node of FIG. 23 with a strut therein, according to embodiments of the present disclosure.
Figure 34:
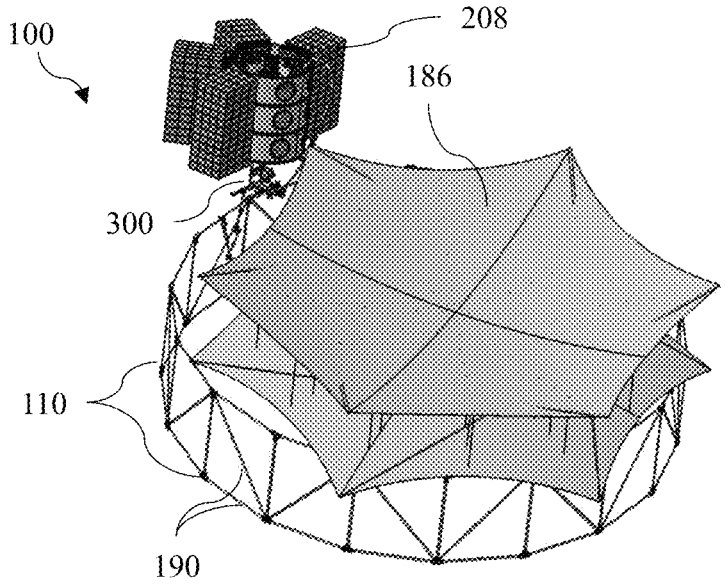
FIG. 34 illustrates a perspective view of a robotic arm installing an unfurled tensegrity structure into the cylindrical rim truss structure to complete an antenna reflector, according to embodiments of the present disclosure.

Referring now to FIGS. 23 and 34, it will be understood that multiple engagement elements can be provided in staggered (e.g., axially offset) arrangements. For example, the node member engagement elements can include first node member engagement elements 144A and second node member engagement elements 144B. Despite being axially offset, the first node member engagement elements 144A and second node member engagement elements 144B can, optionally, simultaneously engage corresponding engagement elements of the strut inserted into the channel 150.

Figure 25:
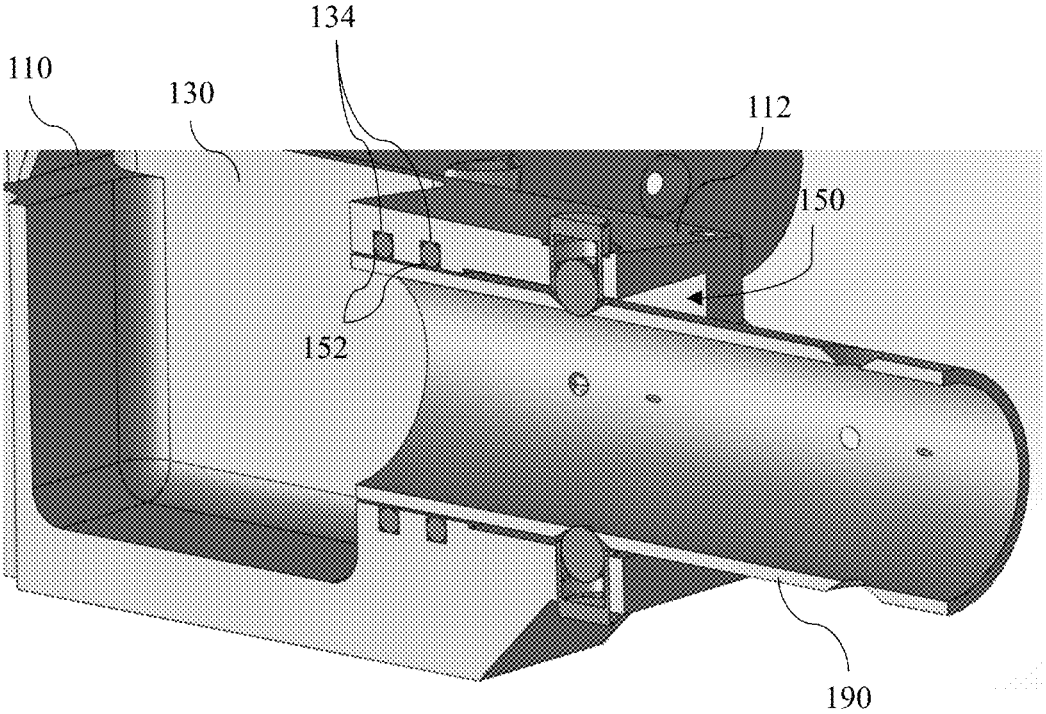
FIG. 25 illustrates a perspective sectional view of a node member and strut, according to embodiments of the present disclosure.

Referring now to FIG. 25, it will be understood that multiple bond elements can be provided in staggered (e.g., axially offset) arrangements. For example, two or more bond elements 134 can be provided for bonding and/or fusing at different axial regions of the node member 110 and the strut 190. The multiple bond elements 134 can be melted simultaneously or at different times.

Referring now to FIGS. 26-35, the struts and node members described herein can be used to assembly one or more of a variety of truss structures. It will be understood that the examples provided herein are not limiting, and that yet other examples and applications are contemplated.

Figure 26:
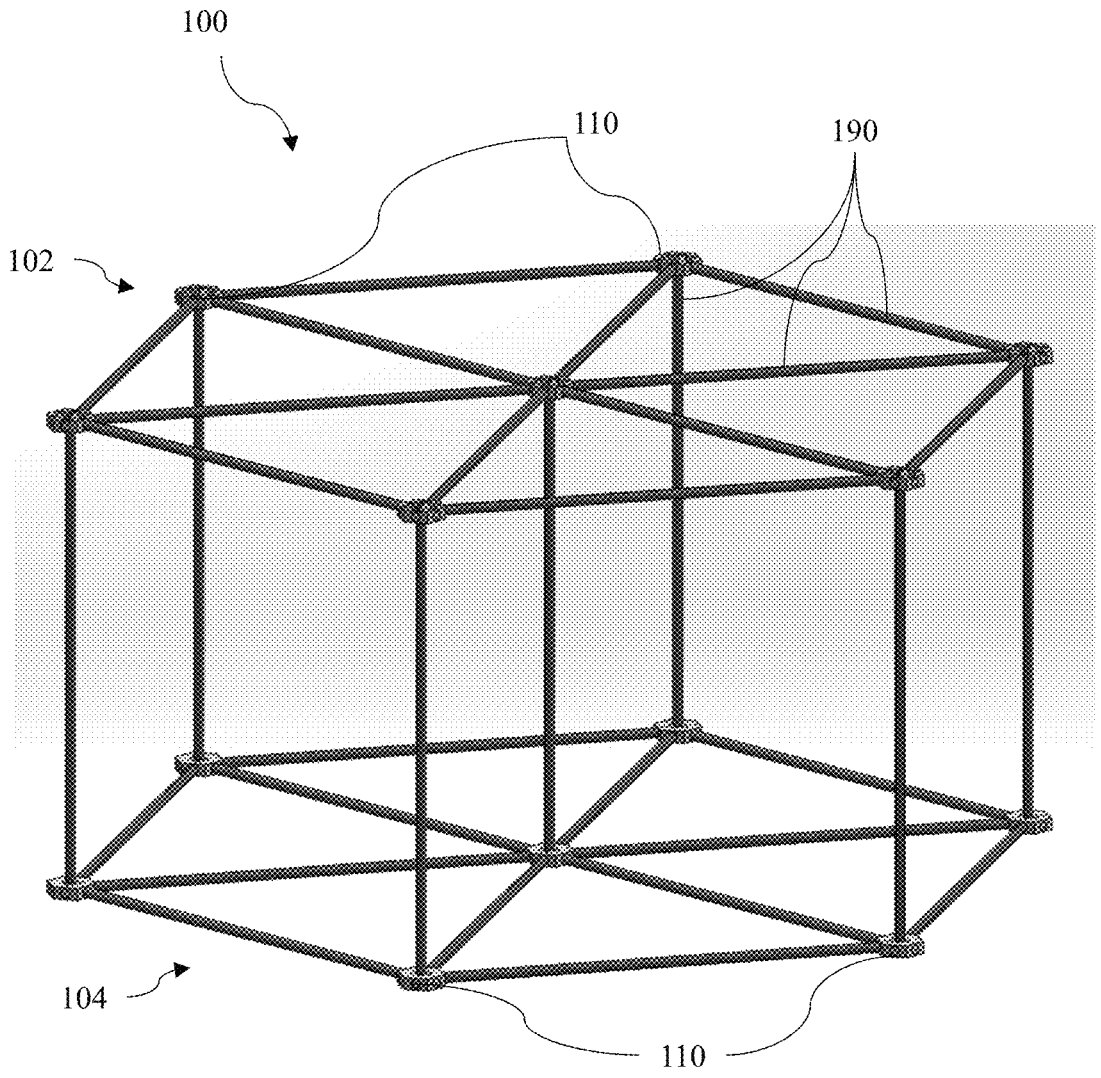
FIG. 26 illustrates a perspective view of an example of a first order (1-ring) truss structure with a hexagonal node design, according to embodiments of the present disclosure.

FIG. 26 illustrates a perspective view of an example of a first order (1-ring) truss structure with a hexagonal node design. As shown in FIG. 26, when full assembled with node members 110 connecting struts 190 in a hexagonal arrangement, a first order (1-ring) truss 100 can be produced. Robotic assembly and welding is enabled by the joint design in which all the weld joints on a side of the truss structure 100 can be welded on a common side of each corresponding node member 110 (e.g., from just the top or bottom of the truss structure 100). For example, the node members 110 on a first side 102 can provide welding areas all facing in a common first direction, and the node members 110 on a second side 104 can provide welding areas all facing in a common second direction. Hence, the robot(s) do not need to work their way in between the top and bottom plane to access the weld joints. Accessibility between the top and bottom planes can become restrictive as the structure gets larger and more complicated, so the robot can assemble and weld a multitude of these truss structure types without needing to be customized to fit within different size truss members and corresponding clearances.

Figure 27:
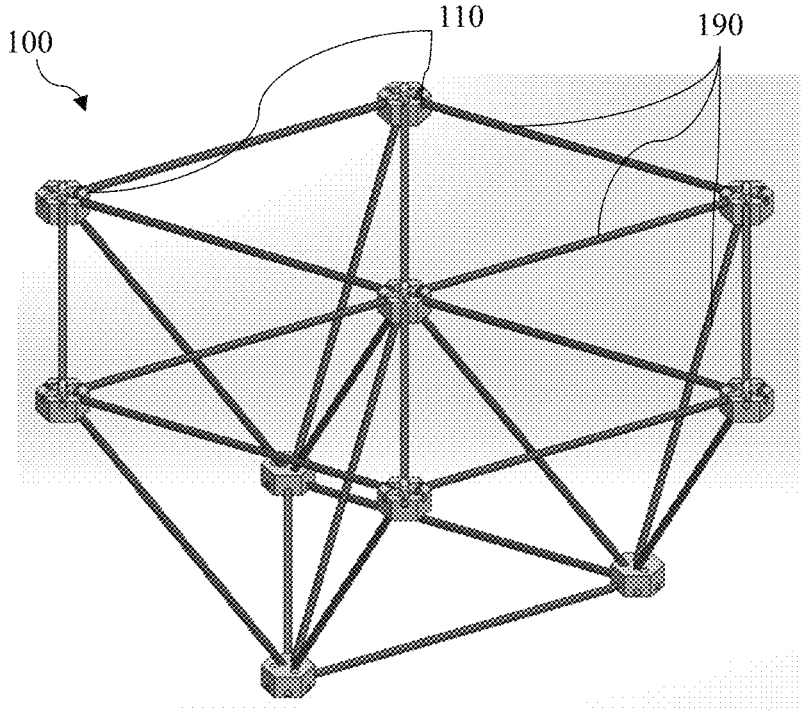
FIG. 27 illustrates a perspective view of an example of a first order (1-ring) truss structure with hexagonal node design, according to embodiments of the present disclosure.
Figure 28:
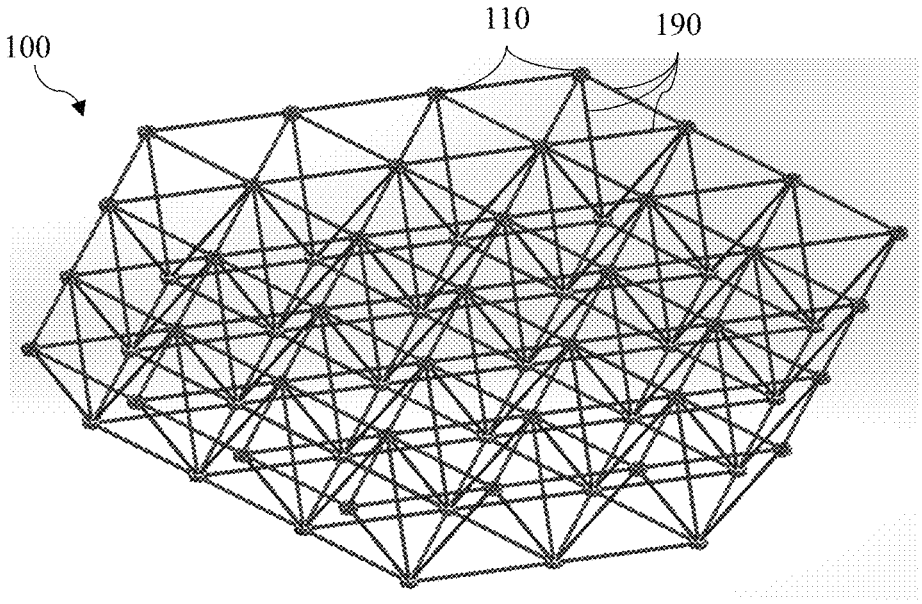
FIG. 28 illustrates a perspective view of an example of a first order (3-ring) truss structure with hexagonal node design, according to embodiments of the present disclosure.

Referring now to FIGS. 27 and 28, a more complex version of the node member described herein is a tetrahedral node member that enables some of the most efficient space frame structures. Such a truss structure 100 uses similar hexagonal strut-to-node connections, but has three struts 190 coming off the bottom instead of just one. A 1-ring tetrahedral and 3-ring tetrahedral truss structure are shown in FIGS. 27 and 28. The additional strut connections requires a thicker node member 110, but all the strut ends of the struts 190 can still be welded from a fixed, swiveling position on the top plane.

While the tetrahedral structure shown in FIGS. 27 and 28 are illustrated with substantially flat top and bottom faces, it will be understood that these structures can have a parabolic curvature to one or both of the top and bottom faces. A substantially parabolic curvature enables placement of mirrors at the nodes for telescope applications. Such structures can also be used for aerobrake applications.

Figure 29A:
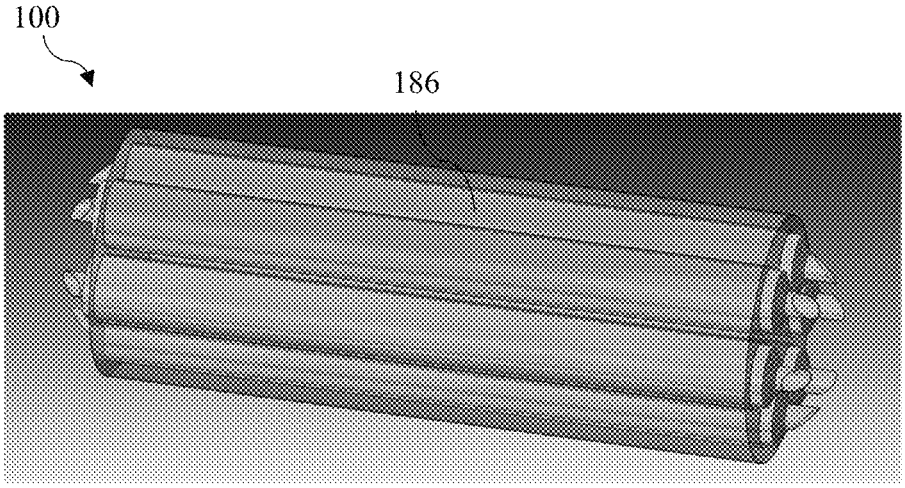
FIGS. 29A and 29B illustrate perspective views of an example of rim truss structure integrated with tensegrity reflector assembly to enable large aperture RF antenna in a collapsed configuration (FIG. 29A) and an expanded configuration (FIG. 29B), according to embodiments of the present disclosure.
Figure 29B:
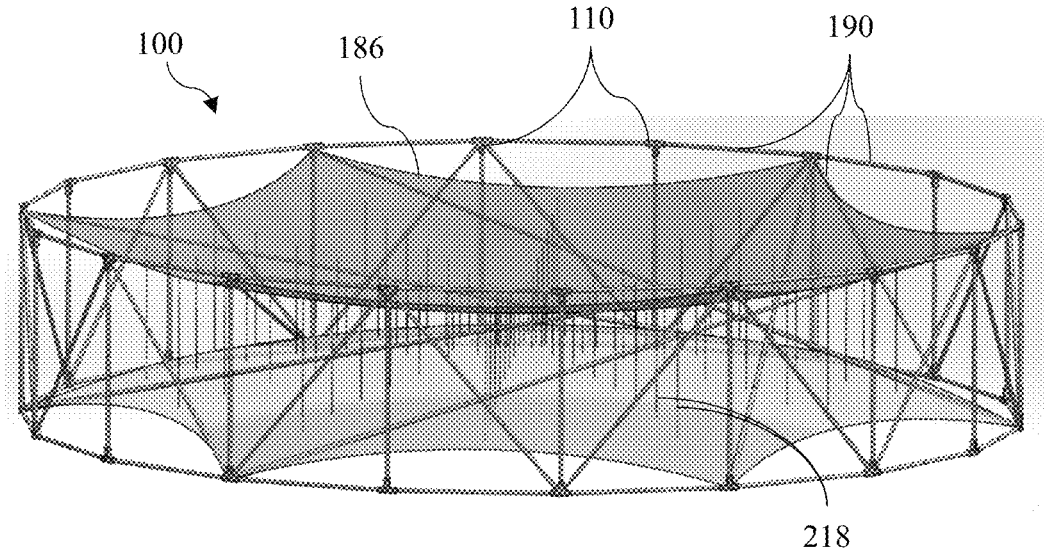

In completion of a cylindrical antenna, the rim truss structure can be integrated with a mesh or mirrored reflecting element to communicate (e.g., with RF signals from Earth). FIGS. 29A and 29B illustrate perspective views of an example of rim truss structure integrated with tensegrity reflector assembly to enable large aperture RF antenna in a collapsed configuration (FIG. 29A) and an expanded configuration (FIG. 29B). As shown in FIGS. 29A and 29B, a reflector element 186 (e.g., mesh) can utilize a tensegrity design that uses struts 190 and tension wires 218 to maintain a large aperture shape with moderate precision. At large diameters, the tensegrity elements interface with the cylindrical rim truss structure via mechanical and/or welded joints at the same node members 110 used for making the rim truss structure 100. The tension wires 218 can be adjusted using robotic arms and mechanisms after it has been joined to the rim truss structure 100.

Figure 30A:
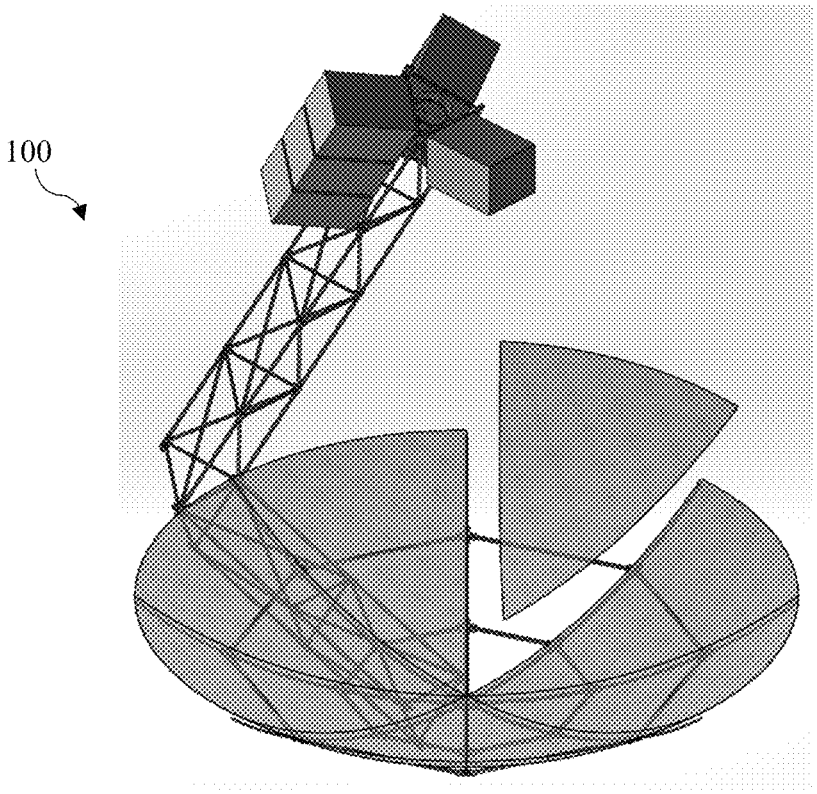
FIG. 30A illustrates a perspective view of an example of a parabolic antenna truss structure design showing various strut and node connections designed for 2-dimensional welding from the exterior position, according to embodiments of the present disclosure.
Figure 30B:
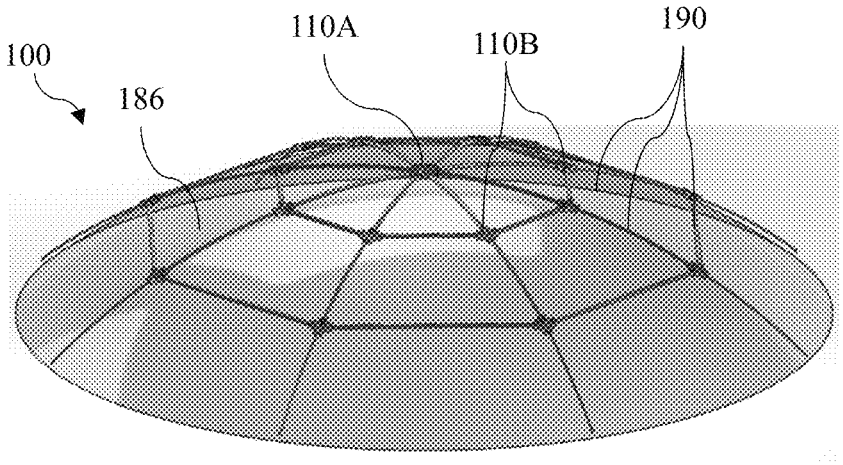
FIG. 30B illustrates another perspective view of the parabolic antenna truss structure design of FIG. 30A, according to embodiments of the present disclosure.

A parabolic antenna truss structure designs can also be provided with the node design described herein. FIG. 30A illustrates a perspective view of an example of a parabolic antenna truss structure design showing various strut and node connections designed for 2-dimensional welding from the exterior position. FIG. 30B illustrates another perspective view of the parabolic antenna truss structure design of FIG. 30A.

As shown in FIGS. 30A and 30B, node members 110A and 110A and struts 190 can be assembled to form a parabolic antenna truss structure 100. Using a node-and-strut design to make the stiffened structure, the node and strut connections are mechanically assembled (e.g., using the robotic arms attached to a powered satellite). The struts 190 start connecting at a central hub node member 110A in the center of the parabolic dish and the additional rings or webs are connected all the way out to the desired perimeter of the dish with cross-member node members 110B. The reflector element 186 can be a metallic mesh that has integrated stiffeners and/or attach points that will connect to holes/attach points on the nodes members 110A and 110B. The parabolic dish shown can also be a mirror or segments of mirrors that attach at the nodes members 110A and 110B (FIG. 30A).

Figure 31:
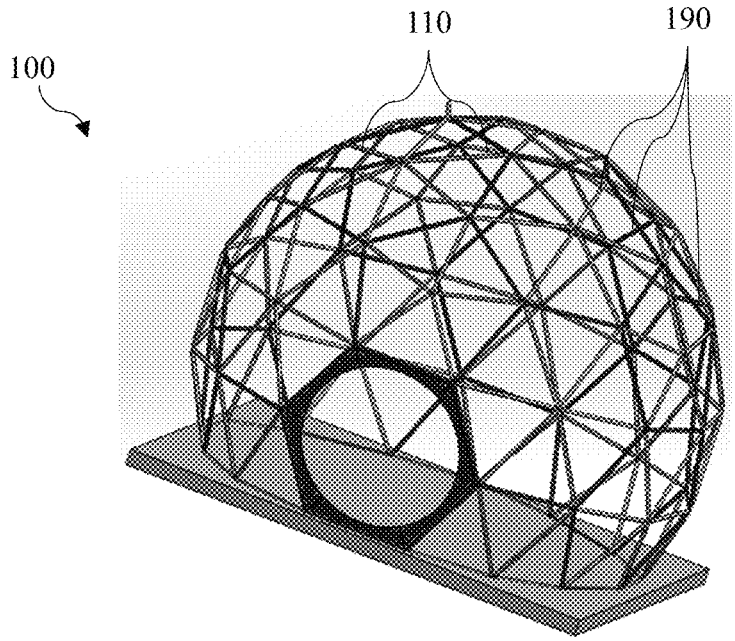
FIG. 31 illustrates a perspective view of an example of a geodesic space frame truss structure with node and strut design, according to embodiments of the present disclosure.
Figure 32:
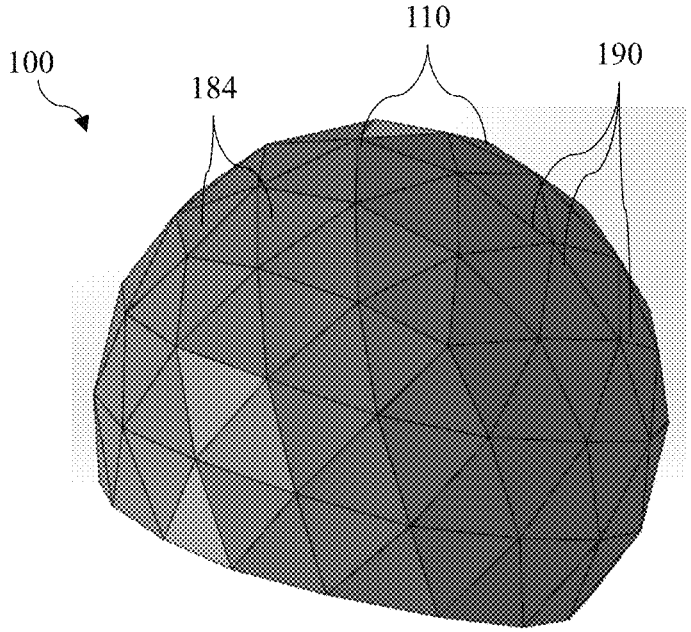
FIG. 32 illustrates a perspective view of an example of a geodesic space frame truss structure with cover panels seal-welded and joined to the nodes to create a hermetically sealed habitat or vessel, according to embodiments of the present disclosure.

Even further concepts for truss structures can lead to sealed vessels that can be used as air-tight habitats or containment of pressured fuels/gases for fuel depots. FIGS. 31 and 32 illustrates perspective views of examples of a geodesic space frame truss structure with node and strut design. As shown in FIGS. 31 and 32, the backbone for this type of structure can use node members 110 and struts 190.

Figure 33:
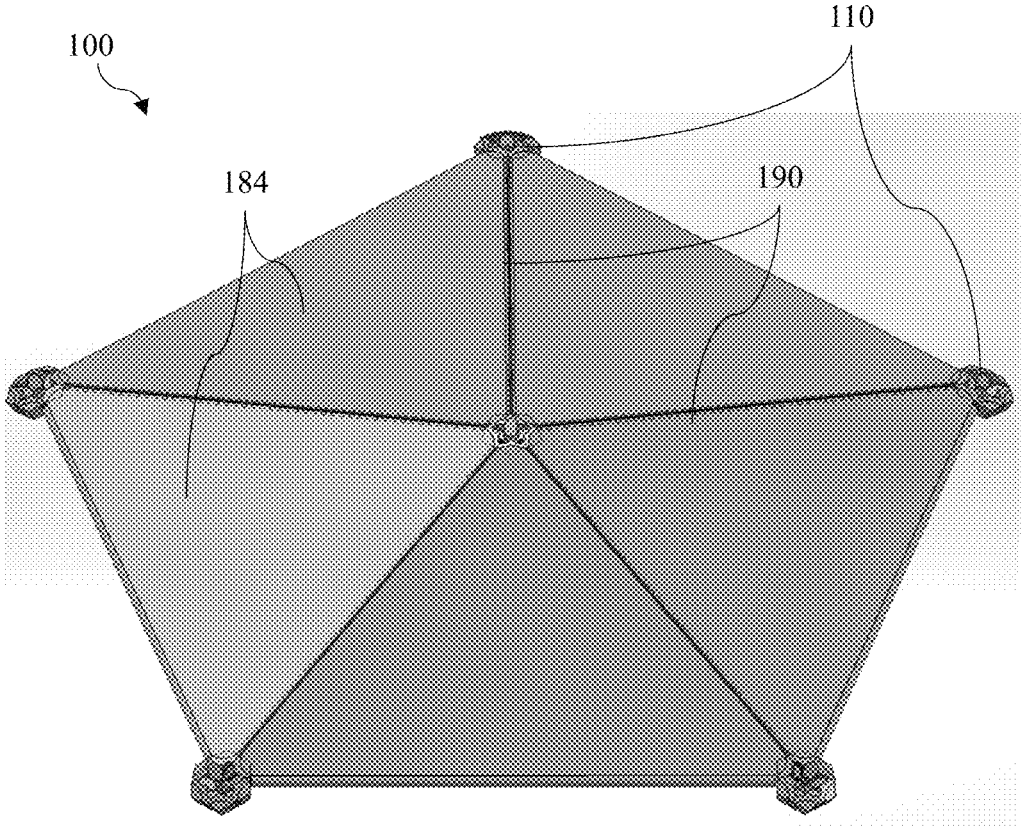
FIG. 33 illustrates a perspective view of an example of a recurring pentagonal node with panels fit up on top of a connecting bar that is supported by strut underneath, allowing the panel to be welded to the bars and nodes in the same 2-D path, according to embodiments of the present disclosure.

FIG. 33 illustrates a perspective view of an example of a recurring pentagonal node with panels fit up on top of a connecting bar that is supported by strut underneath, allowing the panel to be welded to the bars and nodes in the same 2-D path. As shown in FIG. 33, the geodesic vessel is comprised of hexagonal and pentagonal nodes where panels 184 are fit up with struts 190, a machined connector bar, and node members 110 such that each individual panel 184 can be butt-lap welded in 2-dimensions along its perimeter.

Figure 35:
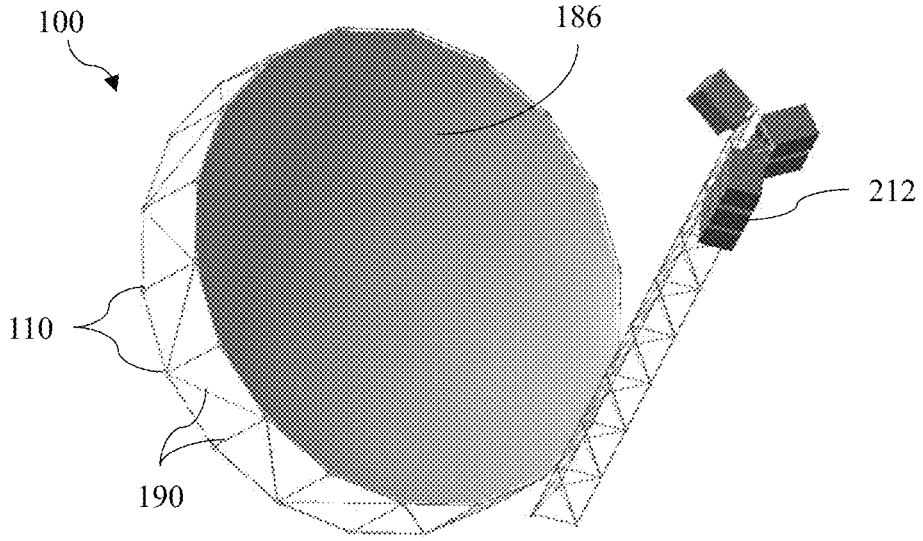
FIG. 35 illustrates a perspective view of an in-space manufactured prismatic truss with subreflector and satlets positioned above the reflector, according to embodiments of the present disclosure.

Referring now to FIGS. 34 and 35, the structures described herein can be assembled by an automated process. The features of the disclosed structures and methods can benefit from an in-space assembled and welded cylindrical rim truss and a tensegrity deployable element to manufacture a functional antenna in space where all the materials required can fit into a minimal payload volume.

The components required for assembly can be stored and transported within a mobile unit 208 having thrust capabilities and assembly mechanisms. As shown in FIG. 34, the mobile unit 208 can assemble a truss structure 100 that serves as structural support for an antenna. The truss structure 100 can include node members 110 and struts 190 that are deployed and welded together as described herein by a welding tool 3000 of the mobile unit 208. A reflector element 186 can be provided and supported by the truss structure 100.

As shown in FIG. 35, other structures can be assembled, such as a prismatic truss structure. These additional structures can be assembled by the same methods and by the same mobile unit. Thus, the versatility of this design allows another form of the structure (e.g., prismatic truss structure) to be utilized on the base structure (e.g., antenna support) to complete the functional antenna by integrating a prismatic truss structure to position the subreflector element 186. The additional components 212 shown on the prismatic truss structure are microsatellites or cubesats that fly as ride shares on the secondary payload adapter.

Accordingly, the designs disclosed herein provide an ability to build structures in space more efficiently to enable capability growth and capability preservation of various space-based functions such as human exploration, scientific discovery, and satellite operations. The structures can be stored in a compact payload and assembled in space. Alignment mechanisms to facilitate automated assembly are provided to produce strong and durable truss structures that can be assembled in space.

Various examples of aspects of the disclosure are described below as clauses for convenience. These are provided as examples, and do not limit the subject technology.

Clause A: a truss structure comprising: a node member comprising: a main body; a channel extending from a periphery of the main body; and a node member engagement element biased to protrude into the channel; and a strut comprising: a terminal end within the channel; an outer strut engagement element for engaging with the node member engagement element while the strut is at a first position within the channel; and an inner strut engagement element for engaging with the node member engagement element while the strut is at a second position within the channel.

Clause B: a node member for a truss structure, the node member comprising: a main body; a channel extending from a periphery of the main body, the channel being configured to receive a strut; a node member engagement element biased to protrude into the channel and engage the strut; and a bond element disposed in an annular recess of the main body radially adjacent to the channel, the bond element being configured to bond to the strut when heat is applied.

Clause C: a method comprising: inserting a first end of a strut into a first node member until: a first end outer engagement element of the strut moves past a first node member engagement element of the first node member; and a first end inner engagement element of the strut engages with the first node member engagement element; aligning a second node member with a second end of the strut; retracting the strut until: the first end outer engagement element of the strut engages with the first node member engagement element; and a second end outer engagement element of the strut engages with a second node member engagement element of the second node member.

One or more of the above clauses can include one or more of the features described below. It is noted that any of the following clauses may be combined in any combination with each other, and placed into a respective independent clause, e.g., clause A, B, or C.

Clause 1: the node member engagement element comprises a ball detent.

Clause 2: each of the outer strut engagement element and the inner strut engagement element comprises a depression on an outer surface of the strut.

Clause 3: each of the outer strut engagement element and the inner strut engagement element forms a conical depression.

Clause 4: the strut is coupled to the main body with an annular bond element radially between the strut and the main body.

Clause 5: the node member further comprises guide members.

Clause 6: the strut extends along a longitudinal axis and the terminal end of the strut defines a face that is directed at an angle with respect to the longitudinal axis.

Clause 7: additional struts, wherein at least one of the additional struts is connected to the node member; and additional node members, wherein at least one of the additional node members is connected to the strut.

Clause 8: a panel extending between and welded to the strut and the additional struts to seal an enclosed space within the truss structure.

Clause 9: guide members at the periphery of the main body and biased toward the channel to urge the strut toward an interior of the channel.

Clause 10: an additional node member engagement element biased to protrude into the channel and engage the strut, the additional node member engagement element being axially offset from the node member engagement element along a length of the channel.

Clause 11: an additional bond element disposed in an additional annular recess of the main body radially adjacent to the channel, the additional bond element being configured to bond to the strut when heat is applied.

Clause 12: the bond element comprises a metal having a melting point that is lower than a melting point of the main body and a melting point of the strut.

Clause 13: an additional channel extending from the periphery of the main body, the additional channel being configured to receive an additional strut; an additional node member engagement element biased to protrude into the additional channel and engage the additional strut; and an additional bond element disposed in an additional annular recess of the main body radially adjacent to the additional channel, the additional bond element being configured to bond to the additional strut when heat is applied.

Clause 14: bonding the first end of the strut to the first node member with a first bond element radially between the first end and the first node member; and bonding the second end of the strut to the second node member with a second bond element radially between the second end and the second node member.

Clause 15: bonding the first end of the strut to the first node member comprises: positioning a heating element within the first end of the strut; and with the heating element, applying heat to weld the first bond element to the strut and the first node member; and bonding the second end of the strut to the second node member comprises: positioning the heating element within the second end of the strut; and with the heating element, applying heat to weld the second bond element to the strut and the second node member.

Clause 16: the heating element is an inductive heating element.

Clause 17: aligning the second node member with the second end of the strut comprises connecting the first node member to the second node member with at least one additional strut.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

What is claimed is:

1. A truss structure comprising:

a node member comprising:

a main body;

a channel extending from a periphery of the main body; and a node member engagement element biased to protrude into the channel; and a strut comprising:

a terminal end within the channel;

an outer strut engagement element for engaging with the node member engagement element while the strut is at a first position within the channel; and an inner strut engagement element for engaging with the node member engagement element while the strut is at a second position within the channel, wherein the strut is coupled to the main body with an annular bond element radially between the strut and the main body.

2. The truss structure of claim 1, wherein the node member engagement element comprises a ball detent.

3. The truss structure of claim 1, wherein each of the outer strut engagement element and the inner strut engagement element comprises a depression on an outer surface of the strut.

4. The truss structure of claim 3, wherein each of the outer strut engagement element and the inner strut engagement element forms a conical depression.

5. The truss structure of claim 1, wherein the node member further comprises guide members.

6. The truss structure of claim 1, wherein the strut extends along a longitudinal axis and the terminal end of the strut defines a face that is directed at an angle with respect to the longitudinal axis.

7. The truss structure of claim 1, further comprising:

additional struts, wherein at least one of the additional struts is connected to the node member; and additional node members, wherein at least one of the additional node members is connected to the strut.

8. The truss structure of claim 7, further comprising a panel extending between and welded to the strut and the additional struts to seal an enclosed space within the truss structure.

9. A node member for a truss structure, the node member comprising:

a main body;

a channel extending from a periphery of the main body, the channel being configured to receive a strut;

a node member engagement element biased to protrude into the channel and engage the strut; and a bond element disposed in an annular recess of the main body radially adjacent to the channel, the bond element being configured to bond to the strut when heat is applied.

10. The node member of claim 9, further comprising guide members at the periphery of the main body and biased toward the channel to urge the strut toward an interior of the channel.

11. The node member of claim 9, further comprising an additional node member engagement element biased to protrude into the channel and engage the strut, the additional node member engagement element being axially offset from the node member engagement element along a length of the channel.

12. The node member of claim 9, further comprising an additional bond element disposed in an additional annular recess of the main body radially adjacent to the channel, the additional bond element being configured to bond to the strut when heat is applied.

13. The node member of claim 9, wherein the bond element comprises a metal having a melting point that is lower than a melting point of the main body.

14. The node member of claim 9, further comprising:

an additional channel extending from the periphery of the main body, the additional channel being configured to receive an additional strut;

an additional node member engagement element biased to protrude into the additional channel and engage the additional strut; and an additional bond element disposed in an additional annular recess of the main body radially adjacent to the additional channel, the additional bond element being configured to bond to the additional strut when heat is applied.

15. A method comprising:

inserting a first end of a strut into a first node member until:

a first end outer engagement element of the strut moves past a first node member engagement element of the first node member; and a first end inner engagement element of the strut engages with the first node member engagement element;

aligning a second node member with a second end of the strut;

retracting the strut until:

the first end outer engagement element of the strut engages with the first node member engagement element; and a second end outer engagement element of the strut engages with a second node member engagement element of the second node member.

16. The method of claim 15, further comprising:

bonding the first end of the strut to the first node member with a first bond element radially between the first end and the first node member; and bonding the second end of the strut to the second node member with a second bond element radially between the second end and the second node member.

17. The method of claim 16, wherein:

bonding the first end of the strut to the first node member comprises:

positioning a heating element within the first end of the strut; and with the heating element, applying heat to weld the first bond element to the strut and the first node member; and bonding the second end of the strut to the second node member comprises:

positioning the heating element within the second end of the strut; and with the heating element, applying heat to weld the second bond element to the strut and the second node member.

18. The method of claim 17, wherein the heating element is an inductive heating element.

19. The method of claim 15, wherein aligning the second node member with the second end of the strut comprises connecting the first node member to the second node member with at least one additional strut.

* * * * *